US009010436B2

(12) United States Patent
Kubichek et al.

(10) Patent No.: US 9,010,436 B2
(45) Date of Patent: Apr. 21, 2015

(54) TENSIONER LATCH WITH SLIDING SEGMENTED BASE

(71) Applicant: Vetco Gray Inc., Houston, TX (US)

(72) Inventors: Benjamin J. Kubichek, Houston, TX (US); Rockford D. Lyle, Pinehurst, TX (US); Jesus J. Garcia, Houston, TX (US); Steven M. Wong, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 138 days.

(21) Appl. No.: 13/714,142

(22) Filed: Dec. 13, 2012

(65) Prior Publication Data

US 2014/0166297 A1 Jun. 19, 2014

(51) Int. Cl.
*E21B 17/01* (2006.01)
*E21B 19/00* (2006.01)

(52) U.S. Cl.
CPC ..... *E21B 17/01* (2013.01); *E21B 19/002* (2013.01); *E21B 19/004* (2013.01)

(58) Field of Classification Search
CPC ..... E21B 17/01; E21B 19/004; E21B 19/006
USPC ..... 166/355, 345, 367; 405/224.2, 224.4
See application file for complete search history.

(56) References Cited

U.S. PATENT DOCUMENTS 3,717,002 A * 2/1973 O'Brien et al. ..... 405/170
4,014,567 A * 3/1977 Arnold et al. ..... 285/24
4,199,847 A * 4/1980 Owens ..... 188/67
4,228,857 A 10/1980 Nobileau
4,397,357 A 8/1983 Hettinger
4,545,437 A * 10/1985 Denison ..... 166/345
4,557,332 A * 12/1985 Denison et al. ..... 166/345
4,616,707 A * 10/1986 Langner ..... 166/345
4,617,998 A * 10/1986 Langner ..... 166/345
4,634,314 A 1/1987 Pierce
4,668,126 A * 5/1987 Burton ..... 405/169
4,712,620 A 12/1987 Lim
4,799,827 A 1/1989 Jaqua
4,818,147 A * 4/1989 Rasmussen ..... 405/224
5,551,803 A * 9/1996 Pallini et al. ..... 405/223.1
5,947,642 A * 9/1999 Teixeira et al. ..... 405/195.1
6,045,296 A * 4/2000 Otten et al. ..... 405/195.1
6,688,814 B2 * 2/2004 Wetch et al. ..... 405/224.2
6,708,765 B1 * 3/2004 Eilertsen ..... 166/350
7,112,011 B2 9/2006 McCarty
7,328,741 B2 2/2008 Allen
7,472,755 B2 * 1/2009 Riggs ..... 166/365

(Continued)

OTHER PUBLICATIONS

PCT Search Report and Written Opinion issued in connection with corresponding Application No. PCT/US2013/073454 on Jul. 15, 2014.

*Primary Examiner* — Matthew Buck
(74) *Attorney, Agent, or Firm* — Bracewell & Giuliani LLP

(57) ABSTRACT

A tensioner assembly for applying tension to a tubular member, such as a riser, can include an upper latch connected to the tubular member, a platform with a bore, and a lower latch ring. After applying tension to the tubular member, the lower latch ring can be closed around the tubular member so that when the tension is released, the upper latch lands on and engages the lower latch. The assembly can include a locking mechanism that prevents axial movement of the upper latch, relative to the lower latch, after engagement. The upper latch can self-center on the lower latch as it is moved into the latching position.

20 Claims, 6 Drawing Sheets

(56) References Cited

U.S. PATENT DOCUMENTS

| | | | | |
|---|---|---|---|---|
| 7,513,308 | B2 | 4/2009 | Hosie | |
| 7,571,772 | B2 | 8/2009 | Reams | |
| 7,588,393 | B1 * | 9/2009 | Shivers et al. | 405/224.4 |
| 7,632,044 | B2 | 12/2009 | Pallini | |
| 7,686,085 | B2 | 3/2010 | Ellis | |
| 7,708,498 | B2 | 5/2010 | Ellis | |
| 7,762,338 | B2 | 7/2010 | Fenton | |
| 7,819,195 | B2 | 10/2010 | Ellis | |
| 7,823,646 | B2 | 11/2010 | Ellis | |
| 7,886,828 | B1 * | 2/2011 | Shivers et al. | 166/355 |
| 8,011,858 | B2 | 9/2011 | Pallini | |
| 8,021,081 | B2 * | 9/2011 | Crotwell et al. | 405/223.1 |
| 8,074,720 | B2 | 12/2011 | Radi | |
| 8,123,438 | B2 | 2/2012 | Pallini | |
| 8,127,854 | B2 | 3/2012 | Haheim | |
| 8,141,644 | B2 | 3/2012 | Ellis | |
| 8,215,872 | B2 | 7/2012 | Pallini | |
| 8,286,714 | B2 | 10/2012 | Ellis | |
| 8,333,243 | B2 | 12/2012 | Pallini, Jr. | |
| 8,388,255 | B2 | 3/2013 | Larson | |
| 8,573,305 | B2 * | 11/2013 | Reddy | 166/343 |
| 2001/0031174 | A1 * | 10/2001 | Olivier et al. | 405/224.2 |
| 2005/0147473 | A1 | 7/2005 | Pallini | |
| 2005/0238440 | A1 | 10/2005 | Jordan et al. | |
| 2006/0108121 | A1 | 5/2006 | Ellis | |
| 2006/0280560 | A1 | 12/2006 | Ellis | |
| 2007/0056739 | A1 | 3/2007 | Ellis | |
| 2007/0063507 | A1 | 3/2007 | Reams | |
| 2007/0181310 | A1 | 8/2007 | Ellis | |
| 2007/0196182 | A1 | 8/2007 | Ellis | |
| 2007/0284113 | A1 | 12/2007 | Haheim | |
| 2008/0128138 | A1 | 6/2008 | Radi | |
| 2008/0166186 | A1 | 7/2008 | Pallini | |
| 2008/0205992 | A1 | 8/2008 | Ellis | |
| 2010/0143047 | A1 | 6/2010 | Pallini | |
| 2010/0183376 | A1 | 7/2010 | Ellis | |
| 2010/0254767 | A1 | 10/2010 | Pallini | |
| 2010/0260556 | A1 | 10/2010 | Pallini | |
| 2011/0008099 | A1 * | 1/2011 | Larson et al. | 403/27 |
| 2011/0011320 | A1 * | 1/2011 | Yemington | 114/122 |
| 2011/0200397 | A1 | 8/2011 | Pallini | |
| 2012/0061091 | A1 | 3/2012 | Radi | |
| 2012/0070225 | A1 | 3/2012 | Wallace | |
| 2012/0099930 | A1 | 4/2012 | Pallini | |
| 2012/0103622 | A1 | 5/2012 | Fenton | |
| 2012/0132435 | A1 * | 5/2012 | Yemington | 166/355 |
| 2012/0201611 | A1 * | 8/2012 | Flores et al. | 405/224.4 |
| 2012/0207550 | A1 | 8/2012 | Aksel | |
| 2013/0092386 | A1 * | 4/2013 | Gilmore et al. | 166/345 |
| 2013/0092390 | A1 * | 4/2013 | Gilmore et al. | 166/367 |

* cited by examiner

TENSIONER LATCH WITH SLIDING SEGMENTED BASE

BACKGROUND OF THE INVENTION

1. Field of the Invention

The present invention relates in general to mineral recovery wells, and in particular to an apparatus and method for supporting a tensioned tubular assembly.

2. Brief Description of Related Art

Tubular members such as wellbore risers are often placed under tension. A riser, for example, can extend from a subsea wellhead upward to a drilling platform. It is often necessary to place a certain amount of tension on the riser. The tension can be applied by, for example, latching the riser into place on the wellhead, and then drawing it upward through an opening in a drilling platform until the riser is subject to the desired amount of tension. The riser can then be latched into place by a latching mechanism on the drilling platform to maintain the tension. Conventional methods of tensioning and latching a riser have numerous problems.

For example, it can be difficult to center the riser assembly within the opening of the drilling platform or within the latching mechanism. If the riser is offset within the opening, then it can be difficult, or even unsafe, to latch the riser in position with conventional latching mechanisms. Those conventional latching mechanisms can include segmented dogs that can engage the riser assembly. It is difficult to engage in the riser with segmented dogs when the riser is offset. Engaging the riser with the segmented dogs can also require personnel to be present on the drilling platform to operate heavy equipment. Safety can be an issue any time personnel are operating heavy equipment, especially in close proximity to a tensioned riser. Furthermore, heavy equipment must be lifted and operated in order to engage the riser with the segmented dogs, which can further present safety issues. Additionally, the conventional latching mechanisms have a large number of moving parts. Those moving parts can be expensive and can have mechanical failures.

Another problem with conventional latching techniques is that they are not able to prevent upward movement of the riser assembly. Under some circumstances, risers can be subjected to upward force that can cause the riser assembly to thrust upward from the drilling platform. Conventional risers are not suited to provide downward support to prevent a riser assembly from thrusting upward.

SUMMARY OF THE INVENTION

Embodiments of the present invention include a method and apparatus for applying tension to a tubular conductor, such as a riser for subsea well drilling operations. Specifically, a tension latch can sit atop a conductor, such as a riser assembly, or on a deck of an offshore platform. As the riser is made up, all segments of the riser system must pass through a rotary or a spider. One constraint for the riser is that the greatest outer diameter ("OD") on the riser must be less than the inner diameter ("ID") of the spider. The same limitation is also present at the tensioner; the largest OD must be able to pass through the tension latch. In the past the tension latch is a segmented ring that pivots backwards inside a housing and leaves an opening to allow the largest member of the riser to pass. Once the riser has moved to the proper location, then the segmented latches can be rotated into position and made up to complete the tensioner system. The segmented latch design in the past has also presented some make up obstacles, such as making up with an offset on the riser due to loading.

In embodiments of the present design, the latch ring includes two separate components. There is a lower latch that can be a segmented ring design that is configured as a single piece component. The upper latch is a solid ring latch that is run on the tension joint. As the riser is run, the lower latch ring and housing assembly are retracted by a spider like device so it does not interfere with the riser running. This allows the riser to pass with no ID limitations once it is through the spider. The tension joint is run with a solid piece latch pre-installed at a predetermined position. Once the riser is close to the landed position the lower latch ring and housing assembly is actuated into place by, for example, a hydraulic powered system (similar to a spider) and fixed in the final position. A c-ring is installed on the upper latch ring, which can provide retaining force should there be an upward force on the tension latch. The lower latch ring and housing assembly can now accept the solid upper latch ring, as it is lowered into place. As the upper latch lands out on the lower latch it compresses the c-ring; once it is fully landed the c-ring will snap back inward into a groove in the lower latch. This c-ring can provide the capability to support an upward force.

The method of operating the system can include inserting a c-ring into a solid upper tension latch and installing the upper tension latch on the tension joint (prior to welding). The tension joint can be passed down through the tensioner with a centralizer ring attached to keep the tension joint (riser) in the correct position. Once the exact location of the upper tension latch is determined, the latch can be rotated on the threads on the tension joint to determine the exact position and be brought to that position. The upper tension latch outer diameter is small enough to pass through the rotary or spider. The lower tension latch is actuated, for example hydraulically, outward while the riser is being (using a device similar to a spider), which allows the riser to pass through easily. Once the tension joint is in the appropriate location the upper tension latch is in place), the lower tension latch is actuated into the proper position. The geometry of the upper tension latch allows it to self-center as it is lowered over the lower tension latch, regardless of initial offset. This will centralize even when the tension joint is at the maximum offset allowed by the tension ring. The upper tension latch lowers over the lower tension latch and compresses the c-ring attached to the upper tension latch and the upper tension latch lands out on the lower tension latch. At the same time, the c-ring snaps into a groove in the lower tension latch. The c-ring provides the necessary area to prevent axial movement of the upper latch, relative to the lower latch, in response to an upward force in the tension joint.

The "Self centering" feature makes installation and running the equipment easier and safer. For example, embodiments of the design do not include dogs or dog teeth to center and engage the riser and, thus, do not require rig personnel to be in the immediate vicinity of the latch and riser during tensioning. The operation is also safer because there is no need for manual labor to move dogs and the lower tension latch is not actuated hydraulically when the riser is under tension. In embodiments having hydraulic actuators, they can be actuated before the riser is placed under tension. Additionally, the self-centering function can center the upper latch and riser more quickly and more consistently than conventional tensioning systems.

Furthermore, embodiments of the tension latch assembly can handle a large load if the tension joint were to generate an upward force, which was not previously possible. In addition to being safer and handling upward force, embodiments of the tension latch assembly use fewer parts than conventional latch designs.

An embodiment of an apparatus for providing tension to a riser includes a platform having a bore therethrough, a tubular member extending through the bore, an annular upper latch member connected to an outer diameter of the tubular member, the upper latch member having a downward facing latch recess on a bottom surface, and a retractable lower latch ring connected to the platform, the lower latch ring being movable from an open position to a latch position. The open position allowing the upper latch member to pass through and the latch position stopping downward axial movement of the upper latch member, the lower latch ring having a cylindrical guide extending upward in an axial direction and having an outer diameter that is less than an inner diameter of the latch recess when the lower latch ring is in the latch position so that the cylindrical guide can fit inside the latch recess.

Embodiments of the apparatus include a downward and inward facing tapered surface extending downward from the latch recess. The tapered surface can center the upper latch member on the lower latch ring when the cylindrical guide enters the latch recess. Embodiments can include an annular lock ring recess on each of an outer diameter surface of the cylindrical guide and an inner diameter surface of the upper latch member, and a resilient lock ring initially positioned in one of the annular lock ring recesses, the lock ring expanding to engage the other annular lock ring recess when the cylindrical guide is positioned inside the upper latch member. The resilient ring can be a c-ring. The lock ring can be initially positioned in the annular lock ring recess of the upper latch member. The resilient ring can engage the latch recess and, thus, prevent the upper latch member from moving axially upward.

In embodiments of the apparatus, the upper latch member threadingly engages the outer diameter of the riser. In embodiments, the upper tension latch is a solid member free of moving parts. Embodiments include a hydraulic actuator connected to the lower latch ring, the hydraulic actuator causing the lower latch ring to move between the open and the closed positions.

In embodiments of a method for tensioning a riser, the method includes the steps of connecting an upper tension latch to a tension joint, the tension latch having a downward facing annular receptacle and the tension joint being a segment of a riser assembly; passing the tension joint downward through an inner diameter of a lower latch assembly to determine the desired amount of tension, then tensioning the riser assembly by drawing the tension joint upward through the lower latch assembly; moving the lower latch assembly from an open position to a latch position, the inner diameter of the lower latch assembly being less than an outer diameter of the upper tension latch when the lower latch assembly is in the latch position; and lowering the tension joint onto the lower latch assembly until a portion of the lower latch assembly occupies the annular receptacle and engages a downward facing surface at the uppermost portion of the annular receptacle to prevent further downward movement of the lower latch assembly.

BRIEF DESCRIPTION OF DRAWINGS

So that the manner in which the features, advantages and objects of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

DETAILED DESCRIPTION OF THE PREFERRED EMBODIMENT

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

Figure 1:
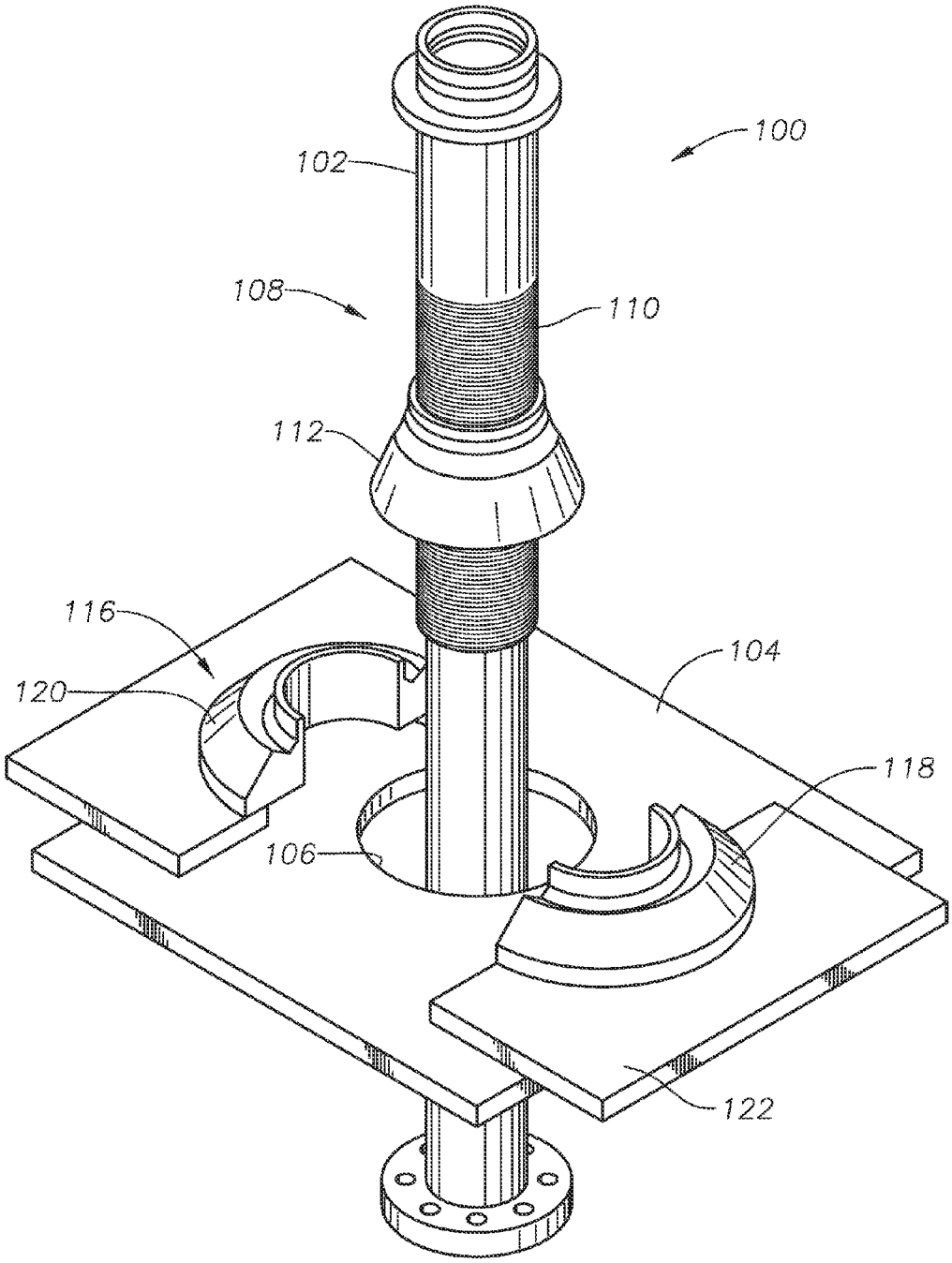
FIG. 1 is an environmental view of an embodiment of the tension latch assembly.

Referring to FIG. 1, a tension latch system 100 is shown. Tension latch system 100 can be used in a variety of applications requiring tension to be applied to a tubular member including, for example, the application of subsea well drilling operations. As shown in FIG. 1, tension latch system 100 is used to apply tension to riser 102, which is a riser extending from a wellhead (not shown) at the ocean floor up to a drilling platform 104 and through bore 106 of drilling platform 104. Riser 102, which can be conventional, is an assembly made up of tubular riser segments. Tension joint 108 is installed as one or more segments of riser 102. Tension joint 108 is a tubular member having threads 110 on an outer diameter surface. Upper latch 112 is installed on tension joint 108 by way of threads 114 (FIG. 3) on an inner diameter surface which threadingly engage threads 110. Upper latch 112 can, thus, be positioned anywhere along the threaded portion of tension joint 108 by rotating upper latch 112. Other techniques can be used to engage and position upper latch 112 on tension joint 108. For example, upper latch 112 can have a ratcheting mechanism (not shown) which can engage threads or wickers (not shown) on tension joint 108. Upper latch 112 has an outer diameter that is smaller than the inner diameter of bore 106 so that upper latch 112, as well as riser 102 and tension joint 108, can pass through bore 106.

Lower latch 116 is a segmented annular ring having segments 118 and 120. In the embodiment shown in FIG. 1, lower latch 116 includes two such segments 118 and 120, each of which is semi-circular. Embodiments can have a greater number of segments which can be assembled to create an annular lower latch assembly. Lower latch 116 is connected to latch support 122. Latch support 122 can be any structure and mechanism that can support segments 118 and 120 as they move between the open and latched position. In the open position, segments 118 and 120 are spaced apart such that upper latch 112 can pass between segments 118 and 120. Segments 118 and 120 move linearly or pivotally between the open and the latch position. The movement can be in response to, for example, a hydraulic actuator, an electric actuator, or any other type of mechanism sufficient to move latch support 122 and latch segments 118 and 120.

Figure 2:
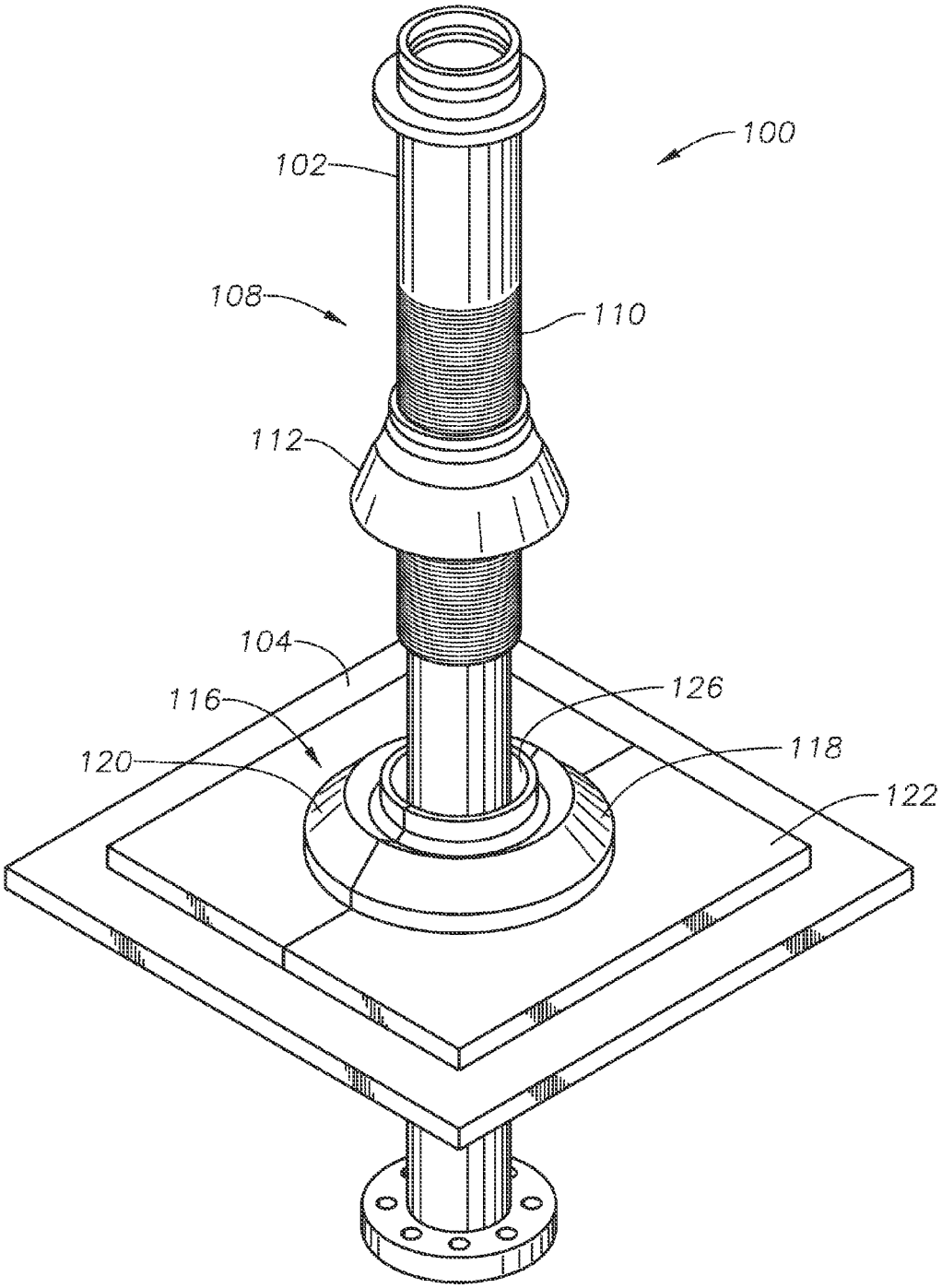
FIG. 2 is a partial environmental view of the tension latch assembly of FIG. 1, showing the latch support and lower latch in the closed position.

Referring now to FIG. 2, lower latch 116 is shown in the latched position. In the latched position, the segments of latch support 122 have moved toward each other so that segments 118 and 120 are brought together to form lower latch 116. Latch 116 has an inner diameter 126, which is larger than the outer diameter of riser 102 so that riser 102 can extend through latch 116 when latch 116 is in the latch position.

Figure 3:
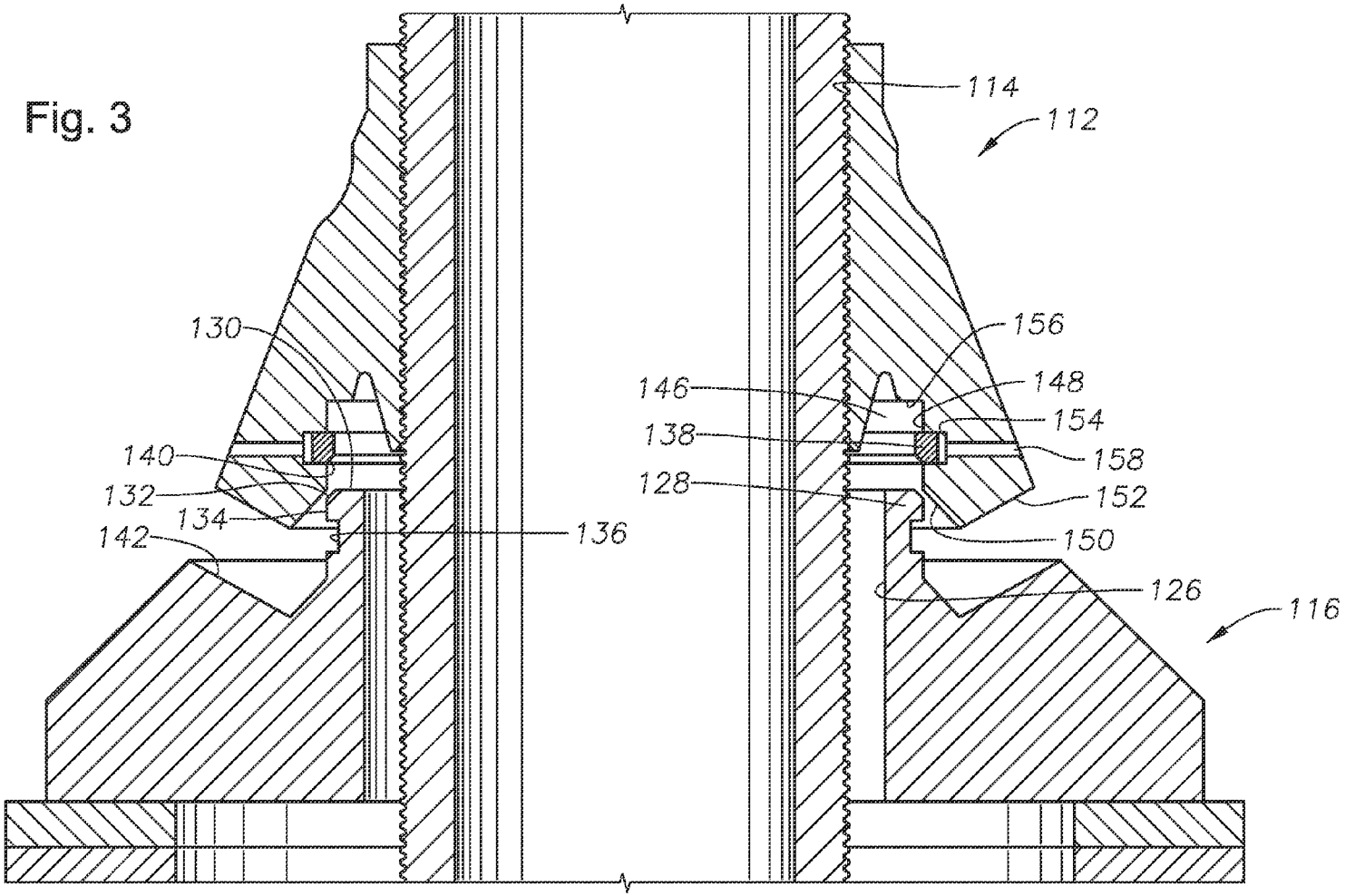
FIG. 3 is a partial sectional side view of the tension latch assembly of FIG. 1.

Referring now to FIG. 3, lower latch 116 has a guide 128 extending upward to define the uppermost portion of lower latch 116. Guide 128 is a cylinder and having the same inner diameter 126 as the rest of tower latch 116. Top surface 130 defines the uppermost portion of guide 128. Top surface 130 can be generally flat or can have a profile. Shoulder 132, the transition from the outer diameter of guide 128 to top surface 130, has an upward and outward facing tapered surface. Guide 128 is shown as a cylindrical guide having a solid cylindrical body, but other configurations of cylindrical guide can be used guide upper latch 112 into concentric alignment with lower latch 116. For example, a plurality of posts or a plurality of arc-shaped segments (not shown) can be spaced apart around lower latch 116, each of the posts or segments (not shown) extending upward from lower latch 116 and having a generally vertical portion for engaging upper latch 112.

The surface of outer diameter 134 of lower latch 116 includes an annular groove 136, which can be located somewhere between the upper and lower boundaries of guide 128. The body of lower latch 116 also includes support groove 142. As shown in FIG. 3, support groove 142 is an upward facing annular groove. Support groove 142 has a v-shaped cross section so that the axial depth increases from the deepest part of the groove when moving radially inward and radially outward.

Still referring to FIG. 3, upper latch 112 has a generally frustoconical shape with an outer surface that generally faces outward and upward, and has a bore therethrough. As discussed above, threads 114 are located on the inner surface of the bore. Upper latch 112 is not limited to a frustoconical shape. The outer surface can be, for example, cylindrical, octagonal, or a variety of other profiles. In embodiments, upper latch 112 can be a solid member free of moving parts.

Latch recess 146 faces downward from the bottom end of upper latch 112. Latch recess 146 is a bore having a bore sidewall 148, the diameter of which is the same is or slightly greater than the outer diameter of guide 128. The opening of latch recess 146 includes a downward and inward facing taper 150. In embodiments, taper 150 can extend at an angle of about 10-80 degrees relative to the axis of upper latch 112. In embodiments, taper 150 can extend at an angle of about 30 degrees to about 60 degrees relative to the axis of upper latch 112. In embodiments, taper 150 can extend at an angle of about 45 degrees relative to the axis of upper latch 112. Outward taper 152 faces downward and outward and is located at the bottom of upper latch 112, proximate to taper 150. The profile of taper 150 and outward taper 152, combined, can be an inverse of the profile of support groove 142.

Figure 5:
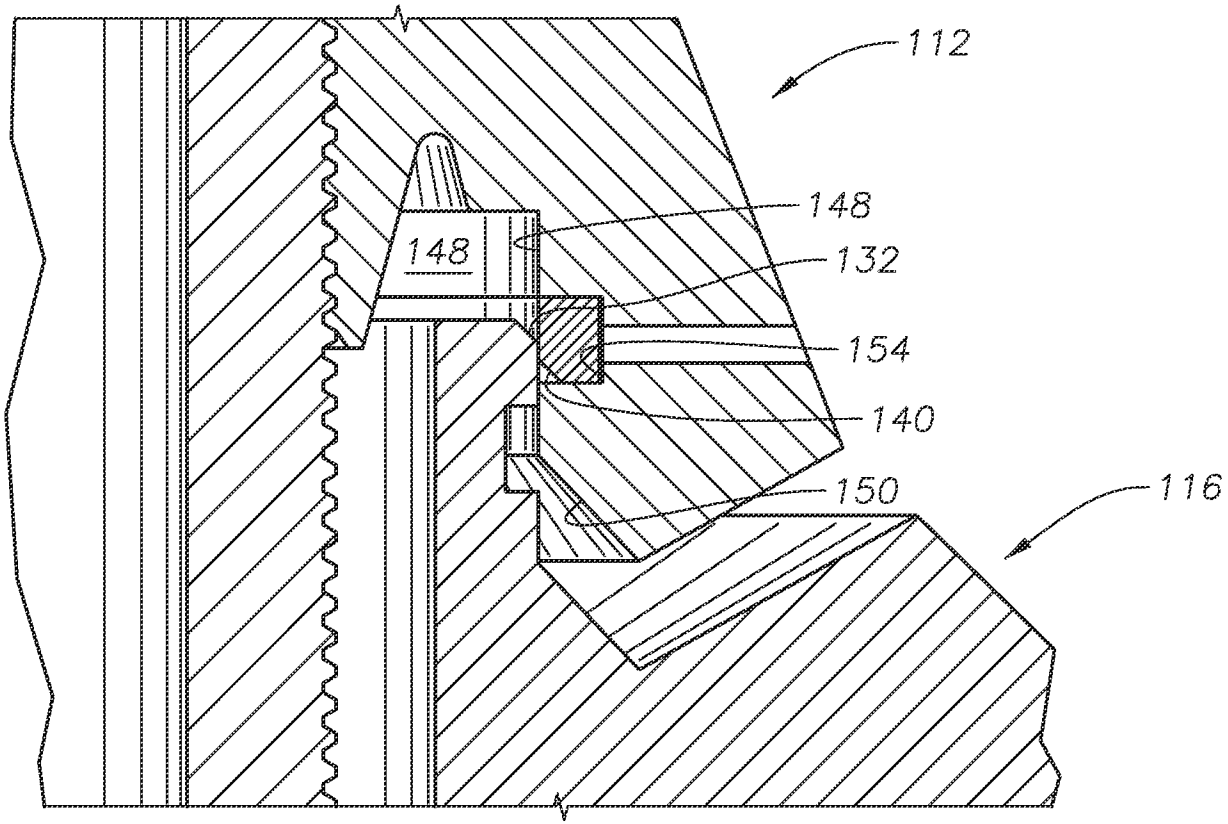
FIG. 5 is a partial sectional side view of the tension latch assembly of FIG. 1 showing partial engagement of the lower and upper latch assemblies.

The upper portion of latch recess 146 includes a downward facing shoulder 156. Shoulder 156 can be generally flat or can have a profile. The shape of shoulder 156 can be the inverse of the shape of top surface 130. The axial length from the uppermost portion of taper 150 to shoulder 156 is about equal to or greater than the axial length from the uppermost portion of the inner leg of support groove 142 to top surface 130 of guide 128. In embodiments wherein that axial length is the same, tapers 150 and 152 can land in and be supported by support groove 142, and downward facing shoulder 156 can land on top surface 130, when tension joint 108 lands on lower latch 116, as best shown in FIG. 5.

Annular lock ring recess 154 is a groove located on bore sidewall 148, such that the diameter of lock ring recess is greater than the diameter of bore sidewall 148. The axial height of lock ring recess 154 is approximately the same as the axial height of groove 136. A resilient lock ring 138 is installed in groove 136. In embodiments, lock ring 138 can be a c-ring. Lock ring 138, in its relaxed state, has an outer diameter greater than the outer diameter of guide 128 and in inner diameter greater than the outer diameter of groove 136. The cross-sectional width of lock ring 138 is less than or equal to the depth of groove 136. Lock ring 138 is installed in groove 136 so that it protrudes outward from the surface of guide 128 but can be compressed into groove 136 until it is flush or nearly flush with the outer diameter surface of guide 128. The upper and outer shoulder 1140 of lock ring 138 is a tapered surface. In some embodiments (not shown), the lock ring can initially be installed in an annular groove on the lower latch such that it expands and engages a corresponding groove on the upper latch when the upper latch lands on the lower latch.

Access ports 158 are passages from the exterior of upper latch 112 to the outer diameter surface of lock ring recess 154. As best shown in FIG. 5, when tension joint 108 is landed on lower latch 116, lock ring recess 154 is axially aligned with groove 136. When latch 112 is positioned on lower latch 116, lock ring 138 expands outward to permit outer diameter 134 of lower latch 116 to pass into latch recess 146. Latch 112 moves downward onto lower latch 116 until lock ring recess 154 is aligned with annular groove 136, at which time lock ring 138 collapses inward to engage annular groove 136. When engaging annular groove 136, lock ring 138 still partially resides in lock ring recess 154 and, thus, prevents axial movement of latch 112 relative to lower latch 116.

Figure 4:
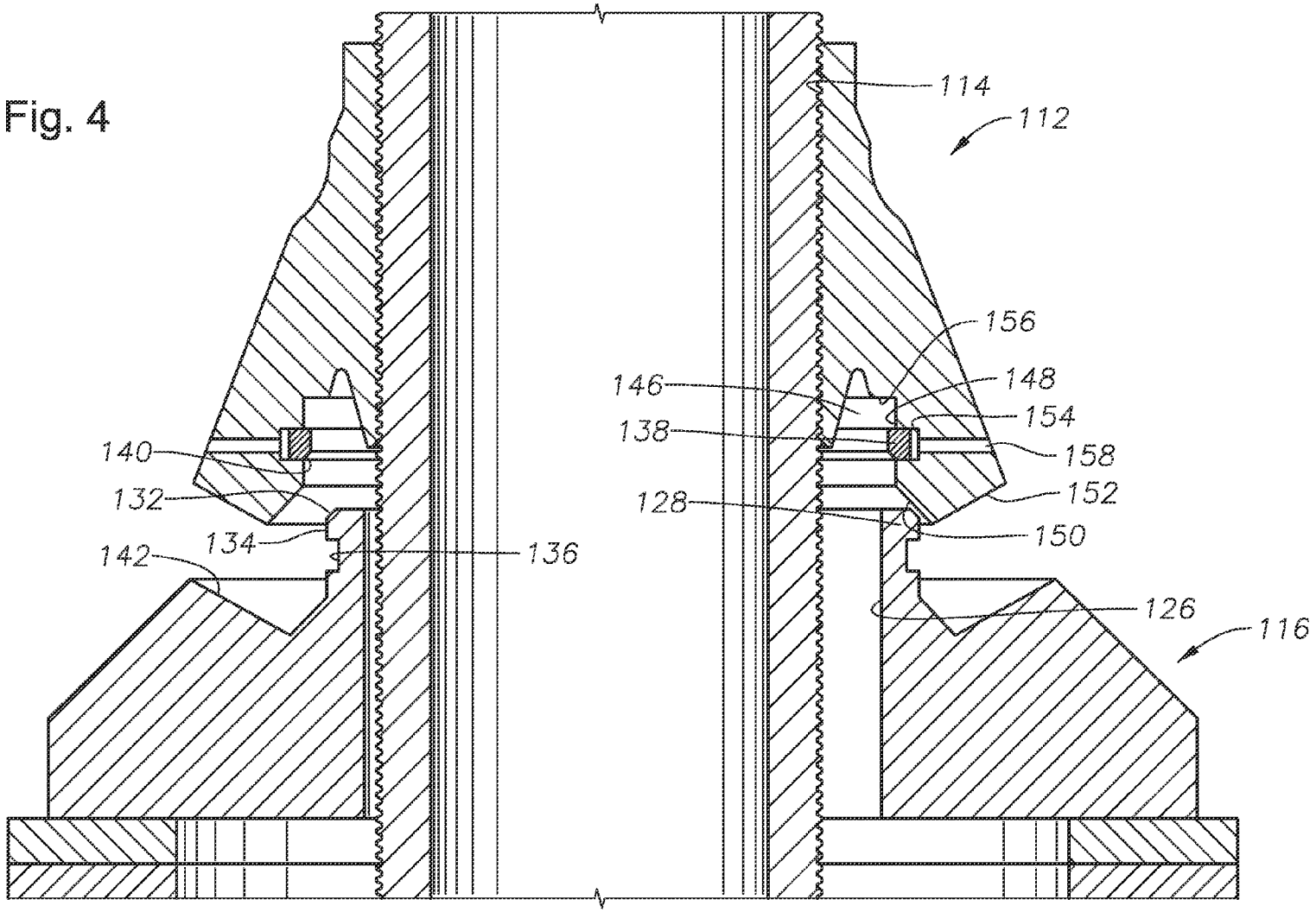
FIG. 4 is a partial sectional side view of the tension latch assembly of FIG. 1 showing an offset condition.

Referring to FIG. 4, in the event that riser 102 is offset in bore 106, lower latch 116 functions as a centralizer to center latch 112, and thus riser 102, as it is latched into place. FIG. 4 illustrates an offset condition. As latch 112 moves downward, taper 150 contacts shoulder 132. Due to the angle of taper 150, taper 150 slidingly engages the contact point of shoulder 132, thereby forcing latch 112 into concentric alignment with lower latch 116 as latch 112 moves downward.

Figure 6:
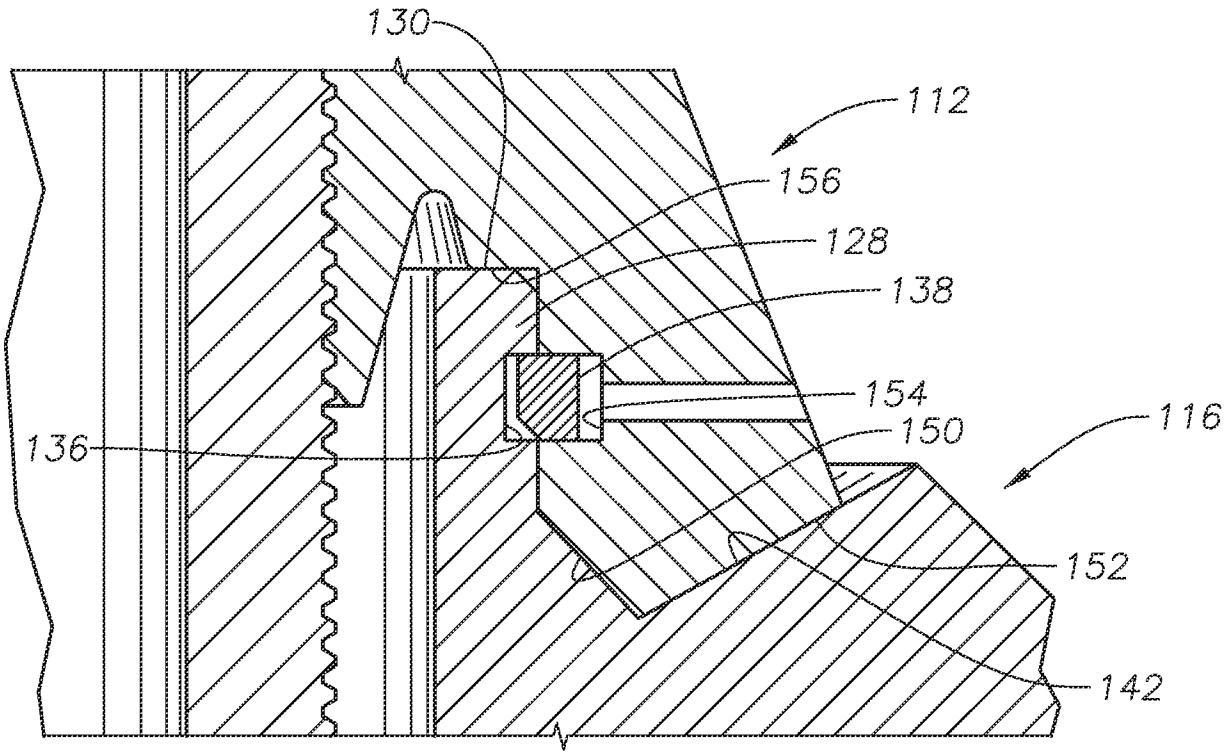
FIG. 6 is a partial sectional side view of the tension latch assembly of FIG. 1 showing the upper latch landed on and lockingly engaged to the lower latch.

Referring now to FIG. 5, as upper latch 112 is lowered onto lower latch 116, taper 150 urges lock ring 138 inward into annular groove 136. Upper latch 112 moves axially downward so that guide 128 of lower latch 116 enters lock recess 146. In embodiments having other configurations of guide 128, such as spaced apart upward extending posts or arc-shaped segments, the posts or arc-shaped segments enter lock recess 146. Referring now to FIG. 6, continued downward movement of latch 112, relative to lower latch 116, causes upper latch 112 to land on lower latch 116. Tapers 150 and 152 land in support groove 142. In embodiments, shoulder 156 can also land on top surface 130. The landed surfaces prevent further downward movement of upper latch 112 relative to lower latch 116 and, thus, prevent downward movement of riser 102 relative to platform 104. Upon landing, lock ring 138 radially expands outward to engage both lock ring recess 154 and annular groove 136, thereby preventing upward movement of upper latch 112 relative to lower latch 116.

Furthermore, the v-shape profile of support groove 142 reduces or eliminates lateral movement of upper latch 112 relative to lower latch 116, thus centralizing riser 102 in bore 106. For example, downward and inward facing taper 150 can engage support groove 142 to prevent lateral movement of riser 102 toward the axis of bore 106, and outward taper 152 can engage support groove 142 to prevent lateral movement of riser 102 away from the axis of bore 106. Because the interlocking surfaces are annular, they prevent lateral movement of riser 102 in any direction relative to bore 106.

While the invention has been shown or described in only some of its forms, it should be apparent to those skilled in the art that it is not so limited, but is susceptible to various changes without departing from the scope of the invention.

What is claimed is:

1. An apparatus for providing tension to a riser, the apparatus comprising:

a platform having a bore therethrough;

a tubular member extending through the bore;

an annular upper latch member connected to an outer diameter of the tubular member, the upper latch member having a downward facing latch recess on a bottom surface; and a retractable lower latch ring connected to the platform, the lower latch ring being movable in a plane generally perpendicular to an axis of the bore from an open position to a latch position, the open position allowing the upper latch member to pass through the lower latch ring and the latch position stopping downward axial movement of the upper latch member relative to the lower latch ring, the lower latch ring having a cylindrical guide extending upward in an axial direction and having an outer diameter that is less than an inner diameter of the latch recess when the lower latch ring is in the latch position so that the cylindrical guide can fit inside the latch recess.

2. The apparatus according to claim 1, further comprising a downward and inward facing tapered surface extending downward from the latch recess.

3. The apparatus according to claim 2, wherein the tapered surface centers the upper latch member on the lower latch ring when the cylindrical guide enters the latch recess.

4. The apparatus according to claim 1, further comprising an annular lock ring recess on each of an outer diameter surface of the cylindrical guide and an inner diameter surface of the upper latch member, and a resilient lock ring initially positioned in one of the annular lock ring recesses, the lock ring expanding to engage the other annular lock ring recess when the cylindrical guide is positioned inside the upper latch member.

5. The apparatus according to claim 4, wherein the resilient ring is a c-ring.

6. The apparatus according to claim 4, wherein the lock ring is initially positioned in the annular lock ring recess of the upper latch member.

7. The apparatus according to claim 4, wherein, when the resilient ring engages the latch recess, the resilient ring prevents the upper latch member from moving axially upward.

8. The apparatus according to claim 1, wherein the upper latch member threadingly engages the outer diameter of the tubular member.

9. The apparatus according to claim 1, wherein the upper latch member is a solid member free of moving parts.

10. The apparatus according to claim 1, further comprising a hydraulic actuator connected to the lower latch ring, the hydraulic actuator causing the lower latch ring to move between the open and the latch positions.

11. A method for tensioning a riser, the method comprising the steps of:

(a) connecting an upper tension latch to a tension joint, the upper tension latch having a downward facing annular receptacle and the tension joint being a segment of a riser assembly;

(b) passing the tension joint downward through an inner diameter of a lower latch assembly to determine the desired amount of tension, then tensioning the riser assembly by drawing the tension joint upward through the lower latch assembly;

(c) moving the lower latch assembly in a plane generally perpendicular to an axis of the upper tension latch from an open position to a latch position, the inner diameter of the lower latch assembly being less than an outer diameter of the upper tension latch when the lower latch assembly is in the latch position; and (d) lowering the tension joint onto the lower latch assembly until a portion of the lower latch assembly occupies the annular receptacle and engages a downward facing surface at the uppermost portion of the annular receptacle to prevent further downward movement of the tension joint.

12. The method of claim 11, wherein step (c) comprises positioning a c-ring on the upper tension latch.

13. The method of claim 12, wherein the c-ring prevents upward movement of the tension joint.

14. The method of claim 11, wherein the upper tension latch further comprises an inward and downward facing taper and step (d) further comprises the step of the taper contacting the lower latch assembly to center the upper tension latch as the tension joint is lowered onto the lower latch assembly.

15. The method of claim 11, wherein the upper tension latch is threadingly connected to the tension joint, and wherein step (b) further comprises the step rotating the upper tension latch on the tension joint to axially move the upper tension latch to a position that will maintain a predetermined amount of tension after step (d).

16. The method of claim 11, further comprising a hydraulic actuator connected to the lower latch assembly and wherein step (c) further comprises the step of the hydraulic actuator causing the lower latch assembly to move from the open to the latch position.

17. An apparatus for providing tension to a riser, the apparatus comprising:

a platform having a bore therethrough;

a tubular member extending through the bore;

an annular upper latch member connected to an outer diameter of the tubular member, the upper latch member having a downward facing latch recess on a bottom surface and a downward and inward facing tapered surface extending downward from the latch recess;

a retractable lower latch ring connected to the platform, the lower latch ring being movable in a plane generally perpendicular to an axis of the bore from an open position to a latch position, the open position allowing the upper latch member to pass through the lower latch ring and the latch position stopping downward axial movement of the upper latch member relative to the lower latch ring, the lower latch ring having a cylindrical guide extending upward in an axial direction and having an outer diameter that is less than an inner diameter of the latch recess when the lower latch ring is in the latch position so that the cylindrical guide can fit inside the latch recess; and an actuator connected to the lower latch ring, the actuator moving the lower latch ring between the open and latch positions.

18. The apparatus according to claim 17, wherein the latch recess comprises a resilient lock ring and the cylindrical guide comprises an annular lock ring recess an outer diameter surface, the lock ring engaging the lock ring recess when the cylindrical guide is positioned inside the upper latch member.

19. The apparatus according to claim 18, wherein, when the resilient ring engages the annular lock ring recess, the resilient ring prevents the upper latch member from moving axially upward.

20. The apparatus according to claim 17, wherein the tapered surface centers the upper latch member on the lower latch ring when the cylindrical guide enters the latch recess.

* * * * *